United States Patent [19]

van der Lely

[11] 4,077,170

[45] Mar. 7, 1978

[54] PREFABRICATED STRUCTURAL ELEMENTS, AND BOX-SHAPED BUILDING SECTIONS FORMED FROM SUCH ELEMENTS

[76] Inventor: Cornelis van der Lely, 7, Bruschenrain, Zug, Switzerland

[21] Appl. No.: 635,042

[22] Filed: Nov. 25, 1975

Related U.S. Application Data

[63] Continuation of Ser. No. 416,644, Nov. 16, 1973, abandoned.

[30] Foreign Application Priority Data

Nov. 17, 1972 Netherlands ..... 7215562

[51] Int. Cl.[2] ..... E04B 1/348

[52] U.S. Cl. ..... 52/79.1; 52/263; 52/265; 52/309.17; 52/601; 52/602

[58] Field of Search ..... 52/79, 236, 263, 234, 52/601, 79.1, 265, 309.17, 602; 403/189, 292, 230, 264, 375

[56] References Cited

U.S. PATENT DOCUMENTS

| | | | |
|---|---|---|---|
| 675,648 | 6/1901 | Beardsley | 52/602 X |
| 1,895,657 | 1/1933 | Geiger | 52/601 |
| 2,255,315 | 9/1941 | Hamilton | 52/264 X |
| 2,703,003 | 3/1955 | Ruppel | 52/601 |
| 3,378,971 | 4/1968 | Singer et al. | 52/236 X |
| 3,442,056 | 5/1969 | van der Lely et al. | 52/79 |
| 3,456,405 | 7/1969 | Hida et al. | 52/263 X |
| 3,470,660 | 10/1969 | van der Lely et al. | 52/236 X |
| 3,484,999 | 12/1969 | van der Lely | 52/601 |
| 3,604,174 | 9/1971 | Nelson, Jr. | 52/601 |

FOREIGN PATENT DOCUMENTS

| | | | |
|---|---|---|---|
| 1,520,408 | 3/1968 | France | 52/79 |
| 708,519 | 5/1954 | United Kingdom | 52/601 |

*Primary Examiner*—Alfred C. Perham

*Attorney, Agent, or Firm*—Mason, Mason & Albright

[57] ABSTRACT

A structural element constituting a panel for a floor, wall or roof of a space defining elongated box-shaped prefabricated section which includes a rectangular concrete slab with a peripheral rectangular frame of beams. A reinforcement network is attached to the frame beams. With I-beams constituting the frame beams, one side of an upper flange is cast within the slab, such flange being connected to the reinforcement network. Recesses are provided at the corners of the slab to receive upright extensions affixed to the top of the upper flanges of the I-beams, such extensions being adapted to receive for attachment columns or other components of the section. The recess provided for the extensions may be spaced therefrom and being filled in with a concrete or other plastic type material when the further component is received on the extension. The extension may extend above the slab without a recess. A covering material may be applied to the top of the slab and folded over its edges. An L-shaped edge piece may be connected to the slab at its upper edges, the vertical leg of the edge piece extending to the exposed edges of the upper flanges of the I-beam and the horizontal leg of the edge piece extending inwardly and being flush with the top surface of the slab. An angle piece member may be connected to the slab at its edges so it is received on top of the upper flange of the I-beam and its vertical portion extends upwardly from the exposed edges of the upper flanges of the I-beam. A further alternative is to furnish a wooden border member with its top flush with the top surface of the slab. Another alternative is to place a wooden beam on top of the slab which is rigidly connected to the I-beam, such wooden beam having a wall affixed thereto. Further, transverse I-beams may be connected to the web and lower flanges of the I-beam spaced below the slab to provide increased rigidity. The same structure is disclosed with channel beams. A wooden frame is disclosed wherein the frame beams are made up of two frame parts connected side-by-side with the outer frame part higher than the inner frame part and the slab received so as to be coplanar with the upper edge of the inner frame part, such upper edge being utilized to secure the reinforcement network. Transverse beams are located between the two longer sides which are the same height as the inner frame part so as to be received in the slab at the level of the reinforcement and beams in place is disclosed as well as a method for utilizing such jig apparatus.

24 Claims, 19 Drawing Figures

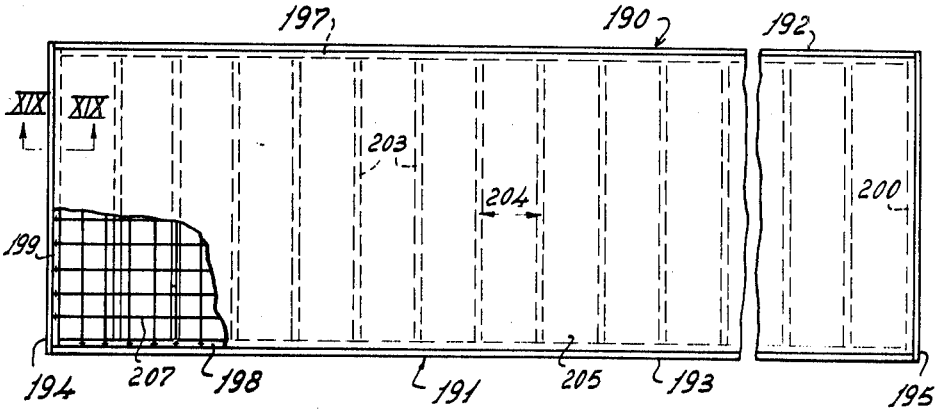
FIG. 18
FIG. 19
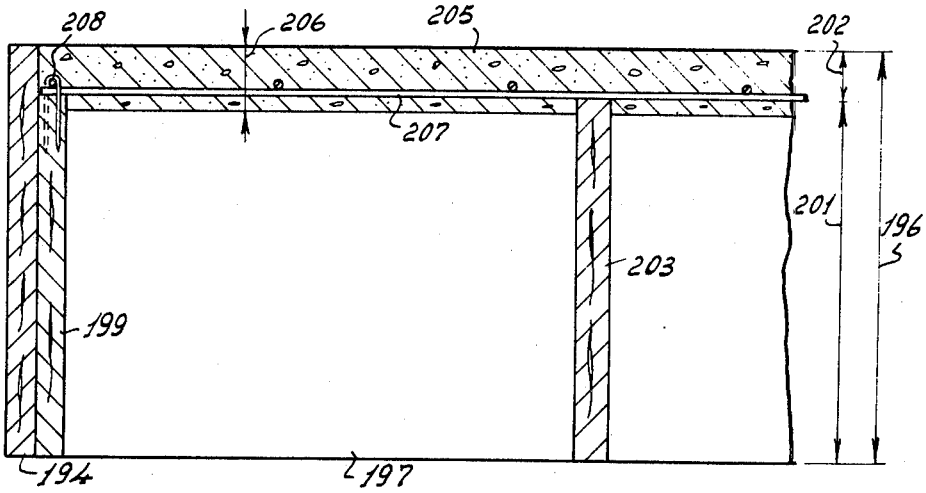

PREFABRICATED STRUCTURAL ELEMENTS, AND BOX-SHAPED BUILDING SECTIONS FORMED FROM SUCH ELEMENTS

This is a continuing application of application Ser. No. 416,644 filed Nov. 16, 1973 now abandoned.

SUMMARY OF THE INVENTION

This invention relates to prefabricated structural elements for use in floors, walls or roofs.

According to a first aspect of the present invention there is provided a prefabricated structural element for a floor, a wall or a roof, the element comprising a slab of concrete or similar cast material and beams of material other than concrete, the beams being located at least mainly on only one side of the concrete slab, with which they are connected so that they are spaced apart from the other side of the slab.

According to a second aspect of the present invention there is provided a prefabricated structural element for a floor, a wall or a roof, the element comprising a concrete slab and beams of material other than concrete, wherein along at least part of the circumference of the concrete slab at least one beam extends over the whole thickness of the concrete slab.

According to a third aspect of the present invention there is provided a structueral element for a floor, a wall or a roof, which element comprises a slab of concrete or a similar cast material and beams of a material other than concrete, wherein along opposite edges of the concrete slab longitudinal beams are arranged, between which and substantially parallel thereto one or more intermediate, longitudinal beams are provided.

According to a fourth aspect of the present invention there is provided a method of manufacturing a structural element as set forth in any one of the above definitions, wherein first a frame of beams is made, after which the frame is arranged in a jig by the side to be in contact with the concrete slab, in which jig the concrete slab is cast so that the concrete slab is secured to the frame of beams.

According to a fifth aspect of the present invention there is provided a jig for use in the method just defined and comprising a jig plate on at least one side of which at least one stationary support and on the other side of which at least one movable support is arranged for holding the frame, while the movable support, at least in the position in which it holds the frame, adapted to be affixed in place with respect to the jig plate.

According to a sixth aspect of the present invention there is provided a box-shaped building section.

A structural element as defined above has a strong structure and a low natural weight as compared with its strength and can be manufactured in a simple manner. By embedding the beams at least partly in the material of th concrete slab, fastening of the concrete slab to the beams can be carried out with low labor expenditure. By providing the concrete slab along at least part of its circumference with a finishing border, the concrete slab can be effectively protected at its periphery. Such a finishing border also facilitates joining the structural element to other structural elements.

If along at least part of the circumference of the concrete slab at least one beam extends over the whole thickness of the concrete slab an advantageous structural element can be obtained, which is satisfactorily protected at the periphery. A satisfactory protection against shock damage, for instance, can thus be obtained.

Fastening of the concrete slab to the beams can be further improved by providing a reinforcement net in the concrete slab, which is secured at least partly to the beams. The span between the beams can be advantageously bridged by using a reinforcement network of bars extending in two different directions, whilst the bars extending in one direction being thicker than the bars extending in the other direction.

The structural element can form a floor-panel, wall-panel or roof-panel in one side of a space-defining, box-shaped building section. The concrete slab provides a satisfactory construction for the floor, the wall or the roof, whereas the beams are effectively employed for fastening other parts of the box-shaped section to the structural element. Fastening of the structural element to other parts of the box-shaped section can be readily carried out by providing the beams of the structural element with extensions to which fit supporting columns in the other sides of the box-shaped section.

If the element comprises three or more beams extending substantially parallel to the long side of the structural element it is possible to obtain a structural element of large width in an advantageous manner. An advantageous embodiment can furthermore be obtained by arranging two beams along opposite circumferential sides of the concrete slab. The use of the structural element is effectively favored by arranging substantially all beams in the same plane with their sides remote from the concrete slab.

BRIEF DESCRIPTION OF THE DRAWINGS

For a better understanding of the invention and to show how the same may be carried into effect, reference will now be made, by way of example, to the accompanying drawings in which:

FIG. 18 is a plan view of a further form of structural element, and FIG. 19 is a sectional view of the structural element shown in FIG. 18, forming a floor panel, taken on the line XIX—XIX in FIG. 18 and drawn to a larger scale.

DESCRIPTION OF THE PREFERRED EMBODIMENTS

Figure 1:
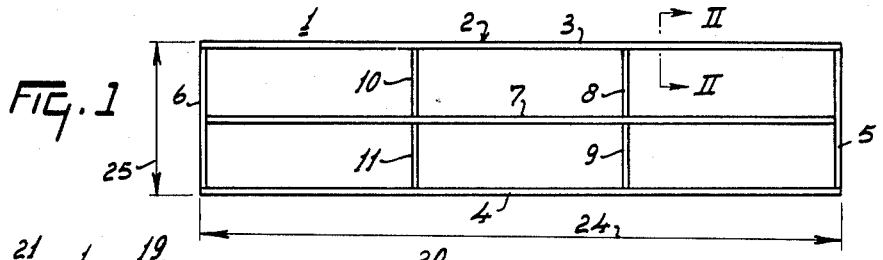
FIG. 1 is an under plan view of a structural element forming a floor panel.
Figure 2:
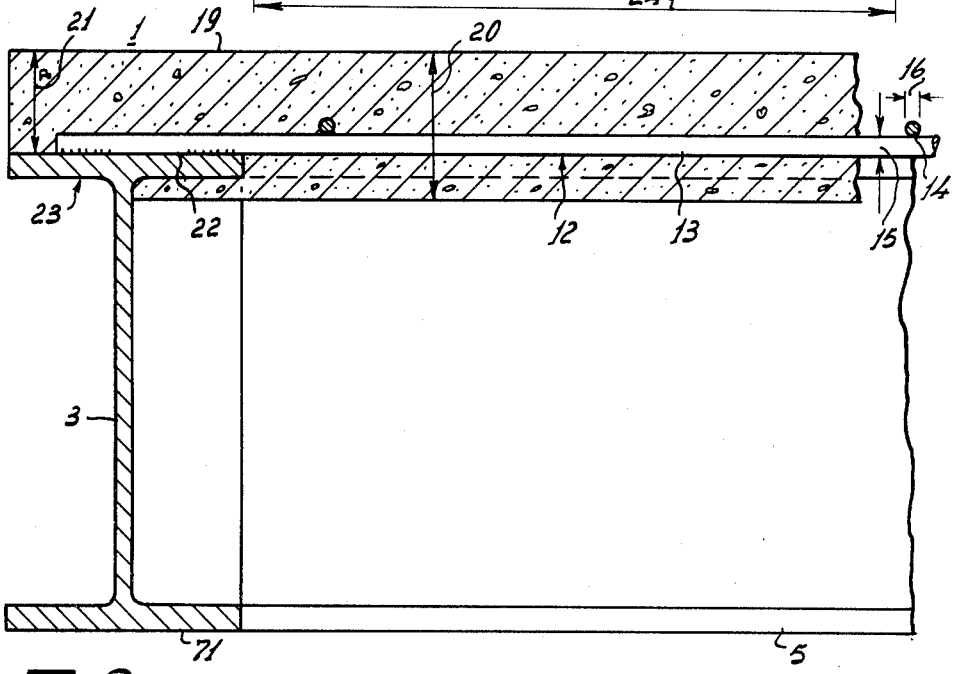
FIG. 2 is a sectional end view of part of the floor panel taken on the line II—II in FIG. 1 and drawn on a larger scale.
Figure 3:
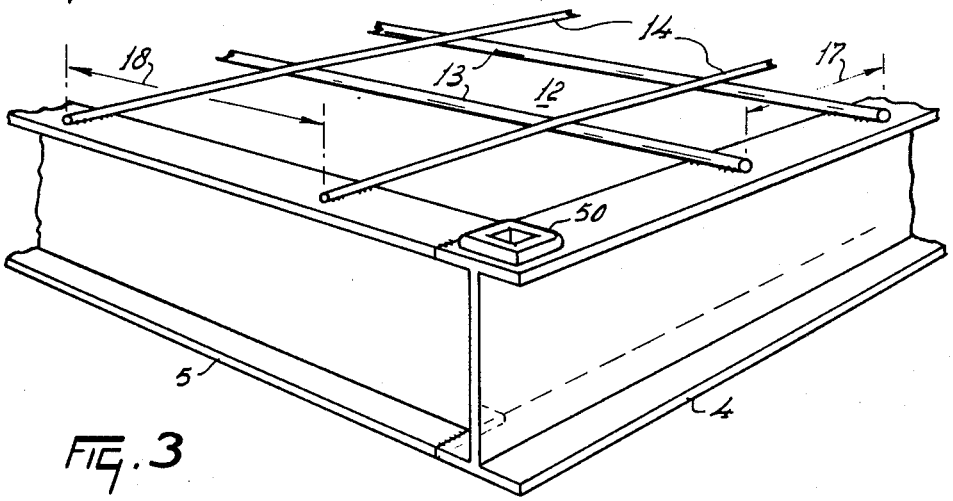
FIG. 3 is a perspective view of a corner part of the floor panel, in which only the metal structure of the element is shown.

The floor panel 1 shown in FIGS. 1 to 3 has a frame 2 constructed of two parallel long beams 3 and 4 interconnected at their ends by short beams 5 and 6, the beams being I-section beams all of the same section height. The flanges of the short beams 5 and 6 join the opposing faces of the flanges of the long beams 3 and 4, to which they are welded. Parallel to the beams 3 and 4 there is a long intermediate beam 7, which also has an I-section profile. Between the beams 3, 4 and 7 transverse beams 8, 9, 10 and 11 extend in the manner illustrated in FIG. 1. From FIG. 1 it will be apparent that the beams 8 and 9 are in line with each other, as are the beams 10 and 11. The beams 8 to 10 have the same shape as the beams 3 to 7 and join, at their flanges, the flanges of the beams 3, 4 and 7, the beams being welded to each other.

On one side of the frame formed by the beams 3 to 11 there is a reinforcement network, which is constructed of transverse bars 13 extending between the beams 3 and 4, and longitudinal bars 14 extending between the beams 5 and 6. The transverse bars 13 have a diameter 15 of eight millimeters and the longitudinal bars 14 have a diameter 16 of about five millimeters. The transverse bars 13 are spaced apart from each other by a distance 17 (FIG. 3) of about twenty centimeters whereas the longitudinal bars 14 are spaced apart from each other by an distance 18 equal to the distance 17.

It is shown in FIG. 3 that the ends of the bars 13, 14 are welded to the beams of the frame 2. If desired, the reinforcement network may also be welded to the beams 7 to 11.

On one side the frame 2 is provided with a concrete slab 19 having a thickness 20 of about five centimeters. The concrete slab 19 extends as far as the outer edges of the frame 2, which is shown in FIG. 2 for one edge. The concrete slab 19 extends by a portion 21 of about 3.5 centimeters beyond the height of the frame 2 and the reinforcement network 12 is completely embedded in the concrete slab. The flanges of the beams 7 to 11 and the facing surfaces of the flanges of the beams of the frame 2 are embedded in the concrete slab, which is shown for the portion 22 of the upper flange 23 of the I-section beam 3 in FIG. 3. The beams 3 to 11 are thus connected with one side of the concrete slab 19 and are located at a distance 21 from the other side of the slab. The concrete slab 19, and hence the structural element as a whole, has a length 24 and a width 25, the length 24 being a multiple of the width 25.

The structural element shown in FIGS. 1 to 3 can be manufactured in a simple manner and has a low weight as compared with its load bearing capacity. The structural element is therefore particularly suitable for use as a floor panel and it may then have fairly large dimensions. In this form the width 25 is 2.5 meters, whereas the length 24 is eleven meters. The width is preferably not smaller than 2 to 2.5 meters and the construction is more suited to widths of 3.50 to 4.25 meters.

The span between the beams 3 and 7 and the beams 7 and 4 in this form is 1.25 meters. This span is preferably not smaller than about 85 centimeters and not larger than 1.40 meters so that the concrete slab 19 need not be thicker than about six centimeters.

With this comparatively large span only few beams need be arranged in the structural element so that the weight thereof may be low. Moreover, the manufacture of the structural element requires few component parts, which is a labor-saving aspect. The thick transverse bars 13 provide a satisfactory support to the concrete slab between the beams 3, 4 and 7 of the frame.

Although in this form the length amounts to eleven meters, it may be larger or smaller, as desired. The construction is particularly suitable for long structural elements having a side of, for example, from eight to fifteen meters.

Although in this form the structural element constitutes a floor panel, this construction may be employed as well for roof panels or wall structures. The construction is, however, particularly suitable for use in load bearing panels such as floor panels. The construction can fulfil an effective function as a panel in a space-defining, box-shaped building section such as the section 30 of FIG. 4, in which the floor panel 1 forms the floor of the section 30.

Figure 4:
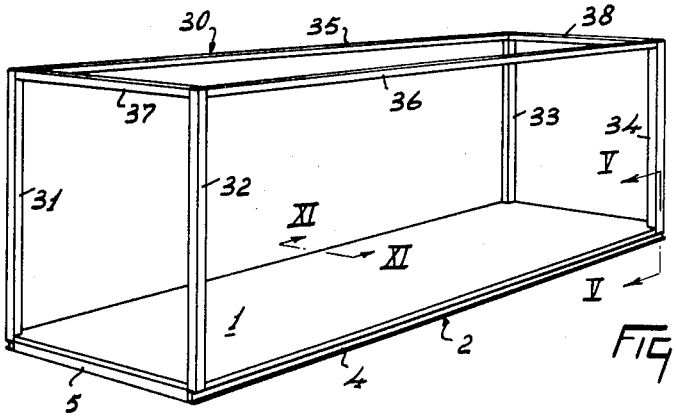
FIG. 4 is a perspective view of the floor panel with columns secured thereto to form a space-defining, box-shaped building section.

In FIG. 4 the corresponding parts of the floor panel are designated by the same referance numerals as used in FIGS. 1 to 3. In order to form a space-defining building section, vertical columns 31, 32, 33 and 34 are arranged at the corners of the floor panel 1. The top ends of these vertical columns are interconnected by beams 35, 36, 37 and 38 as shown in FIG. 4. In this way a parallelepiped-shaped section is obtained, the beams of which constitute mainly the supporting skeleton, being welded together metal beams. Between the vertical columns 31 to 34 walls may be aranged at the desired areas, which may form inner or outer walls of a building assembled at least partly from a section 30.

Figure 6:
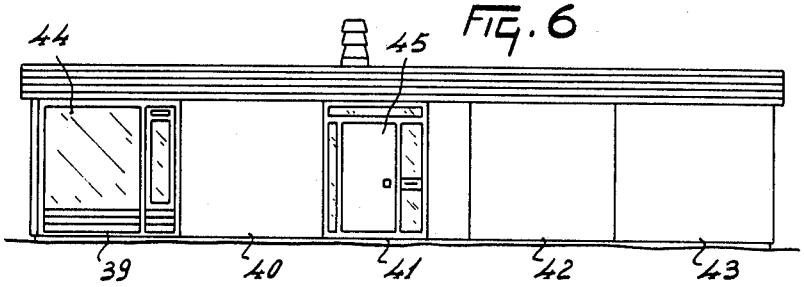
FIG. 6 is an elevation of a bungalow composed of a plurality of box-shaped building sections.

FIG. 6 shows a bungalow assembled from five building sections 39, 40, 41, 42 and 43, the shape of each of which basically corresponds with the shape of the section shown in FIG. 4, the long sides of the sections being joined to each other. In the short sides of each of the sections, walls are provided between the vertical beams such as the columns 31, 32 and 33, 34 of FIG. 4, these walls forming outer walls of the building. These walls are provided at the desired areas with windows and doors, for example a window 44 and a door 45 in FIG. 6. The long sides of the sections 39 and 43, which form outer sides of the bungalow, also have outer surfaces. The inner wall desired in the building can also be arranged inside a section on the floor panels 1 and between the vertical columns of the sections. If desired more than the four columns 31 to 34 shown in FIG. 4 may be arranged on a floor panel 1. In order to fasten the lower ends of the vertical columns to the floor panel 1 the parts of the beams of the frame of the beams 3 to 11 are kept free of the concrete slab 19 at the areas concerned so that the lower ends of the vertical columns can be secured to the beams.

Figure 5:
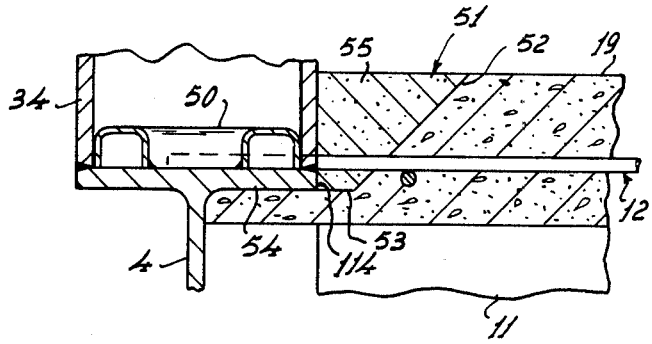
FIG. 5 is a sectional view of the junction of a vertical column with a corner of the floor panel taken on the line V—V in FIG. 4.

FIG. 5 shows the fastening of the lower end of the vertical column 34 to the top end of the beam 4, the beam 4 being provided with an upright rim or flange 50. The flange 50 has an outer circumference such that the inner wall of the vertical column 34 fits around the outside of the flange 50. In this form the column 34 has a hollow square space fitting on the circumference of the upright flange 50, the outer circumference of which is also square. The flange 50 is preferably secured to the floor panel 1 during the manufacture of the panel.

The floor panel 1 is first manufactured and then employed in the construction of the space-defining section 30. By securing the upright flanges 50 to the floor panel during the prefabrication of the panel, the correct places for the vertical columns to be fitted to the floor panel in the construction of the building section 30 are also determined. The flanges 50 ca be secured to the correct places on the structural section in a simple manner during the prefabrication of the panel. It is shown in FIG. 3 that the upright flanges 50 are welded to the metal beams of the supporting frame of the floor panel 1 during the prefabrication thereof. In order to permit welding the lower ends of the vertical columns, for example the column 34, to the beams of the structural element, recesses such as the recess 51 are provided in the concrete slab 19 at the areas of the columns. The recess 51 has slanting sides 52 and a bottom 53 level with the bottom of the flange 54 of the beam 4. After the column 34 is secured to the beam 4, the recess 51 is closed by means of a hardening material 55 so that the top face of the floor slab is smooth up to the vertical columns and joins satisfactorily the vertical columns as is shown in FIG. 5.

Figure 7:
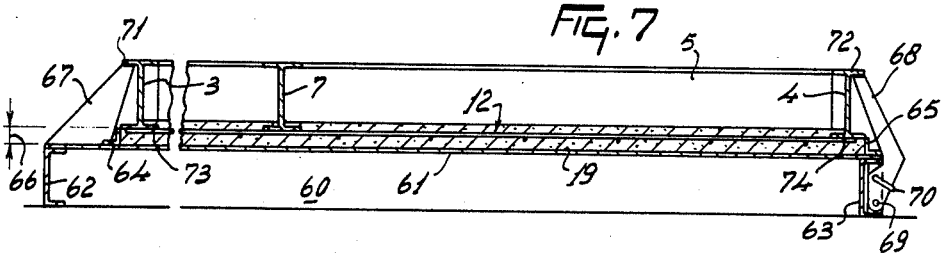
FIG. 7 is a sectional view of a jig structure in which a floor panel as shown in FIGS. 1, 2 and 3 can be assembled.

For the manufacture of a floor panel 1 a jig 60 of the kind shown in FIG. 7 may be employed. The jig 60 includes a jig plate 61 which is supported from beams 62 and 63. On the plate 61 jig beams 64 and 65 are arranged which project above the jig plate 61 by a height 66. The jig 60 also includes stationary supports 67 on one side and removable supports 68 on the other side. The supports 68 turn about pivotal shafts 69 and in the position shown in FIG. 7 they can be locked in place by means of locking pins 70.

The manufacture of the floor panel is carried out as follows. First the supporting frame is made from the metal beams 3 to 11. On the top of the supporting frame is then welded the reinforcement 12. At the desired areas connecting flanges 50 are secured, after which the whole metal structure is placed in the jig 60, the beam 3 being disposed with its flange 71 disposed on two or more supports 67, and the beam 4 with its flange 72 on two or more supports 68, as is shown in FIG. 7. In order to facilitate the insertion of the metal structure into the jig, the supports 68 are turned out of the position shown in FIG. 7 about the pivotal shafts 69. After the metal structure is arranged in the jig, the supports 68 are moved into the position shown in FIG. 7 to support the flange 72. The supports 68 are then secured against rotation about their pivotal shafts by means of the pins 70. The supports 67 and 68 are disposed so that the whole metal structure is held at its correct place in the jig, the circumferential edges of the flanges 73 and 74 abutting the top ends of the beams 64 and 65. The beams 64 and 65 form a circumferential mold on the jig plate 61 equal to the external dimensions of the floor panel 1, i.e. the width 25 and the length 24. Then the concrete slab 19 can be cast in the jig on the plate 61 so that the beams are embedded in the slab by one side and the reinforcement network 12 is embedded inside the floor slab. After adequate hardening of the floor slab 19, which is made in this embodiment of concrete, but which may be of a different cast material, the structural element formed can be removed from the jig 60. For this purpose the supports 68 are turned out of the position shown in FIG. 7. The removal of the structural element 1 may be facilitated by fixing the beam 65 to the pivotable supports 68 or by arranging it in a different way on the top of the plate 61 so as to be detachable.

The use of a jig construction permits a simple and rapid manufacture of structural panels, in which the structural elements always have the same external dimensions.

Although in the embodiment described the height 66 of the beams 64 and 65 is equal to the height 21 by which the concrete slab 19 extends beyond the beams of the frame 2, a different measure may be chosen, if necessary. It is, for example, possible to provide supports 67 and 68 such that the metal structure is located at a greater depth between the beams 64 and 65, the height 21 being thus reduced. The thickness of the slab 19 may, however, be the same. Although in the embodiment shown in FIGS. 1 to 3 the reinforcement network 12 is constructed of thicker transverse bars and thinner longitudinal bars, it may be constructed in a different way.

Figure 8:
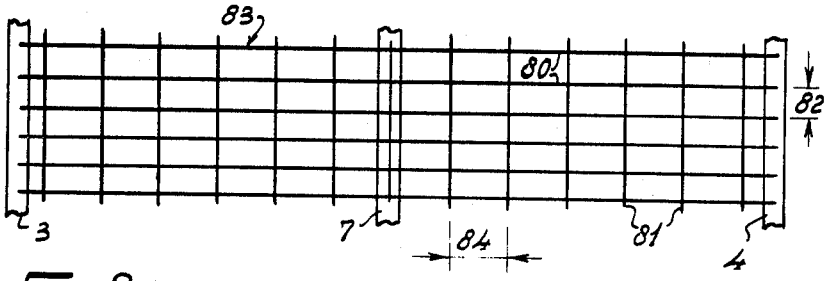
FIG. 8 is a plan view of one form of a reinforcement network for the concrete slab of a floor panel.

FIG. 8 shows part of the embodiment of a floor panel in which the reinforcement network is constructed of bars 80 extending in one direction and bars 81 extending in a different direction. The bars 80 are parallel to the direction of width of the structural element and the bars 81 are at right angles to the bars 80 and parallel to the direction of length of the element. The bars 80 and 81 have equal thicknesses of, for example, five millimeters. The longitudinal bars 81 are spaced apart from each other by a distance 84 of twenty centimeters, and the transverse bars 80 are spaced apart by a smaller distance 82 for adequate support of the concrete slab, the distance 82 being equal to approximately half the distance 84 i.e. about ten centimeters.

Figure 9:
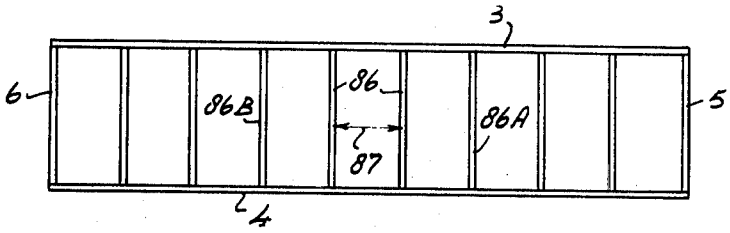
FIG. 9 is a plan view of metal supporting beams in a floor panel.

Although in the embodiment shown in FIGS. 1, 2 and 3 inside the frame 2 a further support for the concrete slab 19 is obtained by a long beam 7 and shorter beams 8 to 11 located on either side of the beam 7, the frame 2 may be provided in a different manner with a plurality of beams between its beams for holding the concrete slab 19. FIG. 9 shows an embodiment in which between the long beams 3 and 4 of the frame 2 a plurality of transverse beams 86 are arranged. The beams 86 are also I-section profiles of equal shape and height as the beams of the frame 2. The beams 86 are parallel to the beams 5 and 6 and are spaced apart from each other by a distance 87 of, for example, about 1.25 meters.

The floor panels are preferably employed so that they are arranged over a length 24 in the building either as floor panels or as the panels of a box-shaped building section as shown in FIG. 4 the panels being supported on the short sides by beams 5 and 6 and at one or more spots in the direction of length. The beams 8 to 11 or the beams 86 are preferably arranged so that they are located at or at least near a support for the floor panel so that the forces exerted on the floor can be absorbed by the beams 8 to 11 and 86 and the beams 5 and 6. The floor panel shown in FIG. 1 may be disposed on beams located in the building beneath the beams 5 and 6 and the beams 8 to 11. The floor panel in the embodiment shown in FIG. 9 may be arranged on supporting beams located beneath the beams 5 and 6 and beneath, for example, only two of the transverse beams 86, for example, the transverse beams 86A and 86B.

Figure 10:
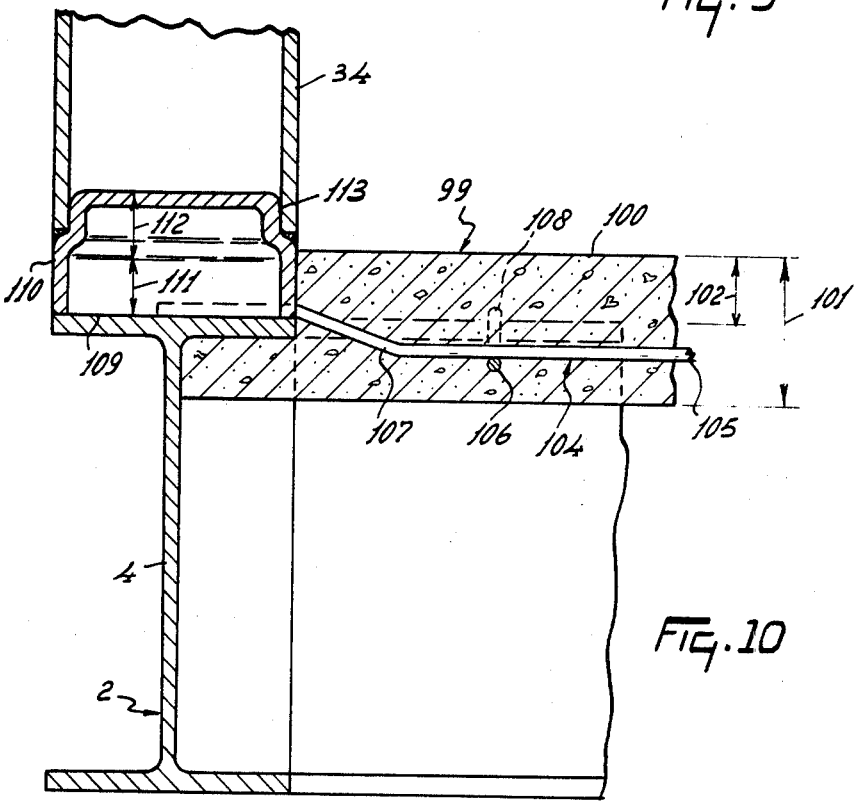
FIG. 10 is a sectional view similar to FIG. 5 of a further form of the junction of a vertical column with the corner of a floor panel.

FIG. 10 is a vertical sectional view of part of a building section 99 forming a floor panel, the frame with the intermediate beams corresponding to the construction shown in FIG. 1. Corresponding parts are therefore designated by the same reference numerals as in FIG. 1. The sectional view of FIG. 10 corresponds with that of FIG. 5. In the embodiment shown in FIG. 10 the structural element has a concrete slab 100 having a thickness 101 equal to the thickness 20. However, the concrete slab 100 projects by a distance 102 of not more than twenty-two millimeters beyond the tops of the frame beams, for example, the top 109 of the beams. The distance 102 is approximately equal to half the thickness 101 and is preferably not smaller than this. The floor panel 100 is provided with a reinforcement network 104 of transverse bars 105 and longitudinal bars 106 like the reinforcement network of FIG. 8. It may, however, also be constructed like the reinforcement network of FIG. 3. Reinforcement network 104 is embedded in the concrete slab 100 so that it is located at a lower level than the flanges of the frame beams embedded in the concrete slab 100, which is indicated in FIG. 10. The ends of the bars, for example, the ends 107 and 108 of the bars 105 and 106 respectively, are bent over so that they are located on and welded to that side of the beams of the frame 2 which is turned towards the top of the concrete slab, which top is remote from the bottom of the floor panel connected with the beams of the frame. In this way a satisfactory location of the reinforcement network 104 is nevertheless obtained in the concrete slab in spite of the fact that the beams of the structural element cover a larger portion of the thickness of the concrete slab.

FIG. 10 shows furthermore a different construction for securing the vertical columns, for example, the vertical column 34, to the floor panel 99. In this construction a fastening stud 110 is provided on the top of the beam 4 of the frame of the structural element. The main body of the stud 110 projects above the beam 4 by a height 111 equal to the distance 102 and has a circumference equal to the circumference of the column 34. Above the body there is a head of height 112, the circumference 113 of which fits in the interior of the hollow column 34. The column 34 fits around this head and is welded to the shoulder between the body and the head as is shown in FIG. 10. Owing to this construction the concrete slab 100 can be arranged without the need for making recesses around the studs 110 like the recess 51 in the embodiment shown in FIG. 5.

The vertical columns 34 may be secured separately to the structural element as in the embodiment shown in FIG. 4. As an alternative the columns may form the vertical edge beams of a further panel in which case between two columns, for example, 31 and 32, a wall is made, which constitutes a wholly or partly closed wall in the box-shaped section at right angles to the floor panel 1. The lower edge of such a wall panel can then join the top of the floor slab 100. In the embodiment shown in FIG. 5 the frame of beams, for example, the beams 33 and 34, may be such that the lower edge of the wall joins the top of the flange 54. In this case the whole width of the element may have a recess 51 for receiving a filling 55 after the wall is arranged on the floor panel. As an alternative the part of the concrete slab 19 at the side of the joint 50 may be prolonged to above the edge 114 of the beam 4 so that the wall located between the beams 33 and 34 joins an upright rim of the concrete slab 19.

Figure 11:
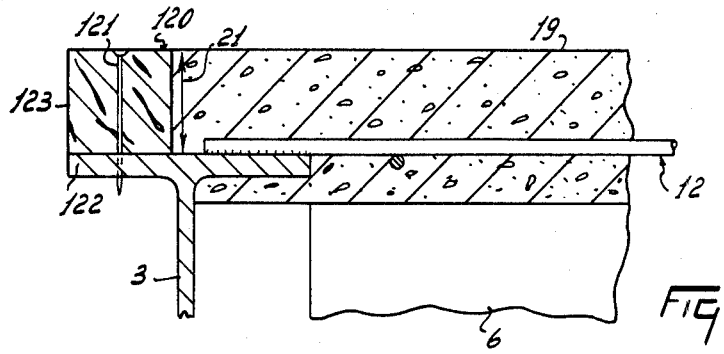
FIG. 11 is a sectional view of a stiffening rim at the edge of the floor panel taken on the line XI—XI in FIG. 4.

FIG. 11 shows part of a floor panel of a construction which corresponds substantially with the construction shown in FIG. 2. Corresponding parts are designated in FIG. 11 by the same reference numerals as in FIG. 2. FIG. 11 shows, however, that the edge of the concrete slab 19 above the flange part 122 of the beam 3 of the frame 2 is provided with a wooden finishing border 120. The border 120 has a height equal to the height 21 of the top part of the concrete slab 19 and is level with the circumferential edge 123 of the outer edge of the beam 3. The finishing border 120 is fastened by means of nails 121 to the flange 122 of the beam 3. The use of a finishing border such as the wooden border 120 has the advantage that the edge of the cast concrete slab 19 will not readily be damaged during transport or during assembly in a building or a building section. The border 120 provides, for example, an advantageous possibility of attachment to a border in a further building section.

Figure 12:
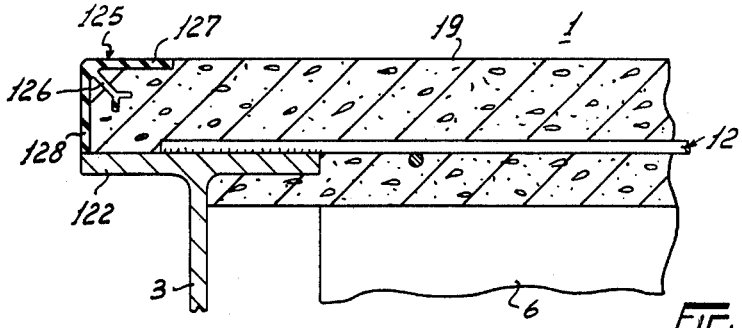
FIG. 12 shows a further form of a stiffening rim at the edge of a floor panel.

FIG. 12 shows a further embodiment of a finishing border. FIG. 12 shows a border 125 formed by an angle-section strip of metal or other material for example, plastics. This border 125 has extensions 126 embedded in the concrete slab 19 for firm fastening of the border to the concrete slab. The horizontal top leg 127 of the border 125 has its upper face level with the top face of the concrete slab. 19. The vertical leg 128 abuts the top of the flange 122 of the beam 3 and has its outer face level with the circumferential edge of the beam 3.

Figure 13:
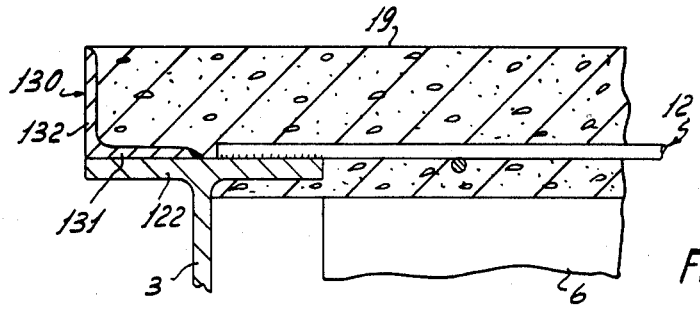
FIG. 13 shows a further form of a stiffening rim at the edge of a floor panel.

FIG. 13 shows a circumferential border 130 formed by a metal angle-section profile, the horizontal limb 131 of which is welded to the top of the beam 3, and the vertical limb 132 of which forms a circumferential border along the concrete slab 19. The limb 132 has its top end level with the top of the slab 19 and its outer face level with the outer edge of the beam 3.

The finishing borders 120, 125 and 130 may be employed in a casting jig, for example, the jig of FIG. 7, as circumferential rims for the jig plate 61. It is then not necessary to provide an uninterrupted jig rim on the plate 61 as is the case in FIG. 7 with the jig rims formed by the beams 64 and 65.

Figure 14:
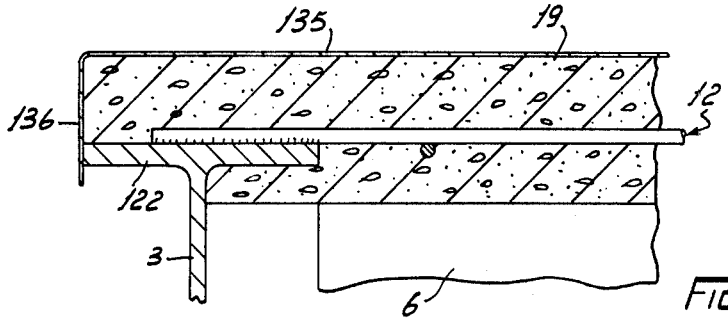
FIG. 14 is a sectional view of a covering layer of the rim and the top face of the concrete slab of a floor panel.

FIG. 14 shows an embodiment in which the top of the concrete slab 19 has a cover layer 135 extending around the circumference of the concrete slab 19 in the form of a finishing border 136. This border 136 also extends along the circumferential edge of the beam 3. the finishing layer 135 with the border 136, if formed by a foil, may be arranged in a casting jig of the kind shown in FIG. 7 before the concrete slab 19 is cast. In this manner the layer 135 and the border 136 are fastened to the slab in a simple manner. The finishing layer 135 with the border 136 are formed integrally and can be, for example, a synthetic resin foil. The layer 135 may be of such material that it constitutes an ornamental layer for the top of the floor panel or, if the panel is used for a wall, an ornamental layer of a wall.

Figure 15:
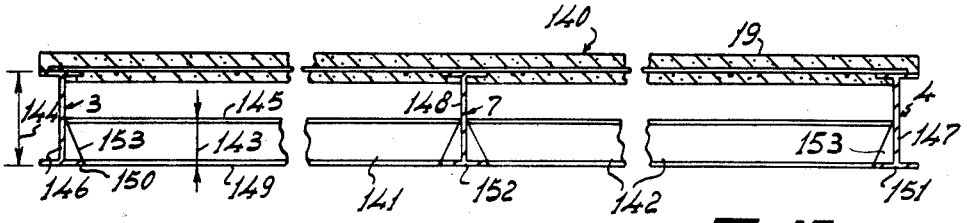
FIG. 15 is a sectional view across the width of a floor panel having another beam structure than that of FIGS. 1 and 2.

FIG. 15 is a cross-sectional view of a structural element 140 forming a floor panel, which sutstantially corresponds to the construction shown in FIGS. 1 and 2. In the embodiment shown in FIG. 15 the beams 8 to 11 are replaced by I-section beams, for example, the beams 141 and 142 having a height 143 equal to half the height 144 of the I-section beams 3, 4 and 7. The transverse beams such as the beams 141 and 142, like the transverse beams 8 to 11 of the first described embodiment, have their lower faces level with the lower faces of the beams 3, 4 and 7. The top flanges 145 of the beams 141 and 142 are welded to the webs 146 and 147 and 148 of the beams 3, 4 and 7, whereas the flanges 149 are welded to the edges of the flanges 150, 151 and 152. For this purpose the ends of the beams 141 and 142 are provided with slanting faces, for example, the slanting face 153 of the beam 141.

Figure 16:
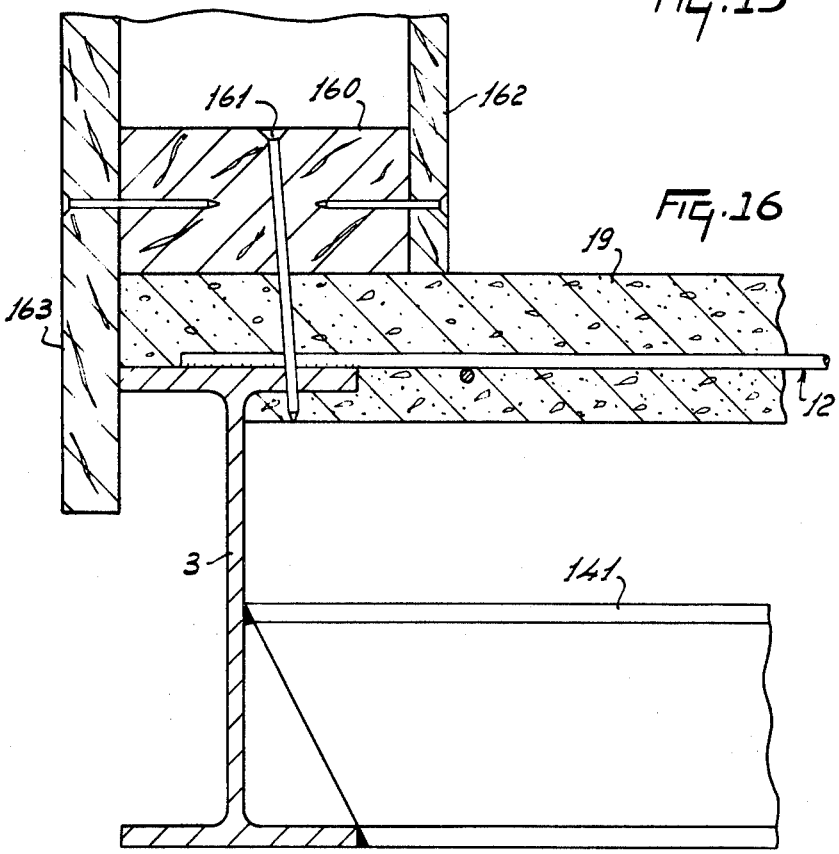
FIG. 16 is a sectional view of the junction of a wall with the edge of a floor panel.

FIG. 16 shows the connection of a wall structure to the edge of a floor panel like the floor panel 140 of FIG. 15. On the top of the concrete slab 19, along the circumference, a wooden beam 160 is secured by means of nails 161. The nails 161 may be rivet bolts and be shot through the concrete slab 19 and the flange 22 of the beam 3. On the inner face of the beam 160 a plate 162 forms the inner side of a vertical wall, whereas on the outer face of the beam 160 a plate 163 forms an outer side of a wall. A wall structure of the kind shown in FIG. 16 may be used in the long sides of the elements 39 and 43 of FIG. 6, these long sides forming outer walls in the bungalow shown in FIG. 6.

Figure 17:
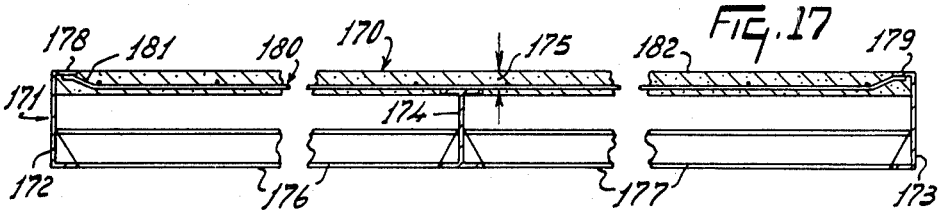
FIG. 17 is a cross-sectional view of a different form of a floor panel.

FIG. 17 shows a cross-section of a floor panel, the circumferential frame 171 of which is formed by channel-section beams such as the beams 172 and 173 in the long sides of the element. The short beams at the ends of the element 170, which interconnect the ends of the beams 172 and 173, have the same height and the same cross-section as the beams 172 and 173. Between the beams 172 and 173, parallel thereto, an I-section beam 174 is provided so that its top is at a lower level than the tops of the beams 172 and 173, whereas its bottom is level with the bottoms of the circumferential frame 171 of the beams 172 and 173. The beams 172, 173 and 174 are interconnected by intermediate beams 176 and 177 corresponding with the beams 141 and 142 of FIG. 15, so that further description may be omitted. On the tops of the I-section beams 174 and on the bottoms of the top flanges of the circumferential beams of the frame 171, for example, the top flanges 178 and 179 of the beams 172 and 173, a reinforcement network 180 is arranged, in which the ends of the bars, for example, the end 181, are bent over upwardly and welded to the bottom faces of the flanges of the circumferential beams, for example, the flange 178 of the beam 172. The structural element 170 includes a concrete slab 182, the thickness of which is equal to that of the concrete slab 19. Reinforcement network 108 is located at a distance 175 from the top of the concrete slab which corresponds with that indicated in FIG. 2 for reinforcement network 12. The concrete slab 182 is arranged, however, so that its top is level with the tops of the flanges of the beams of the frame 171, as is indicated for the flanges 178, 179 of the beams 172 and 173 in FIG. 17. In this way the circumference of the concrete slab 182 is advantageously surrounded by the beams of the frame 171 so that there is no need for providing finishing borders on the structural element 170.

FIGS. 18 and 19 show the construction of a structural element 190. The structural element 190 also forms a floor panel and its dimensions correspond with the dimensions indicated in FIG. 1 for the structural element 1 so that further description may be omitted. The panel 190 includes a circumferential frame 191. The frame 191 has beams 192 and 193 in the long sides, interconnected by beams 194 and 195. To the inner sides of the beams 192 to 195 are arranged beams 197, 198, 199 and 200 so that the bottom faces of the beams 192 to 195 are level with the bottom faces of the beams 197 to 200 as is shown in FIG. 19 for the beams 199 and 194. The beams 192 to 195 have a height 196 and the beams 197 to 200 have a height 201 so that the faces of the beams 197 to 200 are located by a distance 202 of 3.5 centimeter below the top faces of the beams 192 to 195. Between the longitudinal beams 197 and 198 transverse beams 203 are arranged vertically, like the beams 192 to 200, to form ribs. The beam 203 are spaced apart from each other by a distance 204 to about fifty centimeters. The beams 203 have their top faces level with the top faces of the beams 197 and 198, whereas the bottom faces of the beams 203 are coplanar to the lower faces of the beams 197 and 198. The lower faces of the beams 192 to 200 and 203 are all located in a plane which, as for the lower faces of the beams of the preceding embodiments is parallel to the concrete slab 205 or the concrete slabs respectively of the preceding embodiments. Between the frame 191 a concrete slab 205 having a thickness 206 is arranged, which corresponds with the thickness 20 of the concrete slab 19 of FIG. 2. On the top faces of the beams 197 to 200 and the ribs 203 a reinforcement network 207 is arranged and fastened to the top faces of the beams 197 to 200 by means of clamps 208. Reinforcement network 207 is embedded in the concrete slab 205, which can be cast in a jig which basically corresponds with the jig shown in FIG. 7 in which the frame 191 with the intermediate ribs 203 and reinforcement network 207 fastened thereto can be arranged upside down in the jig in order to cast the concrete slab 205 thereto. In such a jig the top face of the frame 191 can be put down on the jig plate, after which the concrete slab can be cast.

The construction of the embodiment shown in FIGS. 18 and 19 also provides a simple, but solid and strong structure of an element which may be used as a panel in the floor, wall- or roof. This construction is particularly suitable, for example, for use as the top of a building section, the concrete slab 205 serving as the bottom or as the top of the building section.

The construction of a structural element as described provides a solid structure suitable for a floor, wall or roof construction. Although in the embodiments shown the structural elements form floor panels, they may equally well constitute wall panels, ceiling panels or roof panels. The structural elements can be employed with particular success in box-shaped building sections in which they may also form a wall panel or a top panel.

Owing to the fairly small number of supporting beams for the concrete slab in the structural elements, only a small quantity of metal is required for the beams. Owing to the small number of beams the number of component parts for a structural element is minimized, which involves minimizing the labor required for the manufacture of such an element. The thin concrete slab allows for rapid hardening in the jig so that the structural element need to be held in the jig only for a short period of time. The thin concrete slab with the small number of beams provides a structural element resistant to breakage or cracking.

Although various features of the structural element and methods which have been described and illustrated in the drawings are set forth in the following claims as inventive features, it is to be noted that the invention is not necessarily limited to these features and encompasses all of the features described and illustrated both individually and in various combinations.

What we claimed is:

1. A structural element which constitutes a panel for a box-shaped prefabricated section, said structural element comprising a slab of concrete-like cast material, beams composed of a material other than concrete, said slab having an upper side and a lower side, said beams connected at substantially only on one side of said slab so that they are spaced vertically apart from the other side of said slab and the upper surface of said slab is higher than the upper surface of said beams, structural columns which are connected to said beams and extend normally therefrom, said columns each being fastened to an upper side of a portion of at least one of said beams, the lower side of said portion having said slab connected thereto, said beams being provided with an extension on the upper side of each said portion adapted to receive said columns, each said extension having circumferential configuration, the periphery of each said column having a uniform cross-section such that its periphery at its end defines a further configuration matched for being received in a close fit by the outer side of its corresponding said extension, the form of each extension and of the part of the corresponding said column receiving same being such that it determines the exact position of said column relative to said beam on which the corresponding said extension is provided.

2. A structural element as claimed in claim 1, wherein each said extension is received in a recess located between the upper portion of said beam on which it is provided and a plane containing said upper side of said slab, filling material being in said recess embedded about the end of said column.

3. A structural element as claimed in claim 1, wherein each said extension projects above the plane containing said upper side of said slab and has its base embedded in part in said material of said slab.

4. A structural element as claimed in claim 1, wherein said columns have a rectangular cross-section and join said extensions provided at the corners of said element, said extensions having matching rectangular cross-section.

5. A structural element which constitutes a panel for a floor for a box-shaped prefabricated section, said structural element comprising a slab of concrete-like cast material, beams composed of a material other than concrete, said slab having an upper flat surface and a lower surface, said beams being connected on one of their respective sides at a level between said upper surface and said lower surface to said slab with their other respective sides spaced outwardly from the adjacent edge of said slab, columns connected to said beams extending normally therefrom, said columns being fastened to an upper side portion of said beams, the lower side of said portion having said slab connected thereto, said beams provided with an extension on each said portion adapted to receive said columns, each said extension having a circumferential configuration the outer side of which is matched to receive the interior lower peripheral part of the corresponding column, said extension extending upwardly from the beam to which it is fastened to a level lower than the level of said upper surface, a recess in said slab in the area thereof adjacent each said extension and larger than the lower part of said corresponding columns received thereon, said recess receiving a hardening sealing material which substantially fills it to the same level as said upper surface.

6. A structural element as claimed in claim 5, wherein said upper side of said concrete slab is provided with a finishing layer.

7. A structural element as claimed in claim 6, wherein said finishing layer is vertically disposed metal layer comprising one side of an angle piece which is a peripheral part joining the circumference of said concrete slab over the thickness thereof, the other side of said angle piece being horizontal and in juxtaposition with the upper surface of said beam, a peripheral portion of said slab disposed above said horizontal side of said angle piece.

8. A structural element as claimed in claim 6, wherein said finishing layer is a plastic layer which is connected with a peripheral part joining the circumference of said concrete slab over the thickness thereof.

9. A structural element as claimed in claim 8, wherein said finishing layer extends substantially over the entire upper surface of said slab.

10. A structural element which constitutes a panel for a floor of a box-shaped, prefabricated section, said structural element comprising:

a rectangular slab composed of a cast concrete-like material;

a peripheral rectangular frame of I-beams having its outside dimensions substantially the same as the dimensions of said slab, said I-beams of said frame being of substantially the same cross-sectional dimensions and rigidly connected together whereby their upper and lower flanges fall within parallel planes, one side of the upper flange of said I-beams received substantially in the lower portion of said slab, said slab having been cast whereby said upper flange side is received affixed therein and said slab extends over the upper surface of upper flange;

a reinforcement network also cast within said slab attached to said upper flange;

a recess provided at each corner of said slab; and an upright extension affixed to the top of said upper flange in said recess snugly receiving the lower peripheral sides of an upright structural column provided in said section.

11. A structural element in accordance with claim 10, wherein the edges of each said recess are spaced from said extension, said recess adapted to be filled with a hardening plastic sealing material to level with the top surface of said slab when said further component is received on said extension.

12. A structural element in accordance with claim 10, wherein each said recess closely receives said extension, said extension extending above the top of said slab.

13. A structural element in accordance with claim 10, wherein a covering material is applied to the top of said slab and the edges thereof, said covering material extending down from said slab edges substantially covering the exposed edges of said upper flanges.

14. A structural element in accordance with claim 10, wherein a "L" shaped edge piece is connected to said slab at its upper edges substantially about its periphery, the vertical leg of said edge piece extending to the exposed edges of said upper flanges, the horizontal leg of said edge piece extending inwardly relative to said slab and being at its top flush with the top surface of said slab, extensions extending towards said upper flanges from said "L" shaped piece, embedded in said slab firmly fastening it thereto.

15. A structural element in accordance with claim 10, wherein an angle piece member is connected to said slab at its edges substantially about its periphery, the vertical flange of said angle piece member extending upwardly from the exposed edges of said upper flanges, the horizontal flange of said angle piece member extending inwardly relative to said slab and being on top of said upper flanges of said I-beams and with said slab cast so as to be in juxtaposition with the top of the horizontal flange of said angle piece member and with the inward face of the vertical flange thereof.

16. A structural element in accordance with claim 10, wherein a finishing border member is rigidly connected to said frame of said I-beams sustantially about its periphery to the top of said upper flange, said border member being of substantially rectangular cross-section and its outer side substantially flush with the outer edge of said upper flange, its inner sides substantially in juxtaposition with the outer edge of said slab, its lower side in juxtaposition with the top of the outboard portion of said upper flange, and its upper side flush with the top of said slab.

17. A structural element in accordance with claim 10, wherein said frame of I-beams are interconnected from opposite sides by further I-beams which are rigidly connected thereto, said further beams being substantially entirely spaced below said slab and having their lowest aspects contained in the same plane as the lowest aspects of said first mentioned I-beams.

18. A structural element in accordance with claim 10, wherein a wooden beam is rigidly connected to said frame of I-beams on top of said slab about its periphery by connection members extending through said slab and into said upper flange, said wooden beam being rectangular in cross-section and having its outer edge flush with the adjacent outer edge of said slab and the outer edge of the outboard portion of said upper flange, the inboard vertical face of said wooden beam having a vertically disposed wall member affixed thereto, the outboard vertical face of said wooden beam having a further wall member affixed thereto, said further wall member extending downwardly to below said upper flange and being in juxtaposition with said outboard portion of said upper flange, said outer edge of said slab and said outboard vertical face of said wooden beam.

19. A structural element in accordance with claim 10, wherein the form of said extension and the column received thereon is such that it determines the exact position of said column relative to said beams.

20. A structural element which constitutes a panel for a floor for a box-shaped prefabricated section, said structural element comprising a slab of concrete-like material, said slab having an upper flat surface and a lower surface, beams formed of a structural material other than concrete, a portion of said beams being connected to the periphery of said slab at a level which is lower than said upper surface and higher than said lower surface, said portion of beams having locations on an upper side which are free of said slab, said portion of beams having structural columns extending normally from said locations to the top of the section, extensions mounted at said locations on said beams each having a circumferential configuration which snugly receives the lower peripheral part of the corresponding said columns, said portion of beams including two parallel longitudinal beams connected to said slab on opposite sides thereof and two parallel transverse beams arranged between said longitudinal beams, a further longitudinal beam between said two longitudinal beams and parallel thereto, all said longitudinal beams and said transverse beams having the same height, their upper sides being at a level between said upper surface and said lower surface.

21. A structural element which constitutes a panel for a floor to be incorporated in a box-shaped prefabricated section, said structural element comprising a rectangular slab composed of a cast concrete-like material, a peripheral rectangular frame of I-beams having its outside dimensions substantially the same as the outside dimensions of said slab, said I-beams all having substantially the same cross-section and being rigidly connected together whereby their upper and lower flanges fall within parallel planes, one side of the upper flange of said I-beams received substantially in the lower portion of said slab with the upper surface of said upper flange substantially covered by said slab which is in direct contact therewith, said slab having been cast with said upper flange side received affixed therein and said lower flange spaced apart from the bottom of said slab, a reinforcement network also cast within said slab attached to said upper flanges, a recess provided at each corner of said slab, an upright extension mounted on the top of said upper flange in each said recess, each said extension snugly receiving an upright column provided at each vertically disposed corner of the section, said frame of I-beams being rigidly and structurally interconnected under said slab across opposite sides by a plurality of further beams only, said further beams all being spaced entirely below said slab and having their lowest aspects contained in the plane of said I-beams.

22. A structural element which constitutes a panel for a floor to be incorporated in a box-shaped prefabricated section, said structural element comprising a concrete slab and a frame-work of rigidly connected metal I-beams surrounding said slab with an upper flange of said I-beams rigidly connected to said slab, a reinforcement network embedded in said slab which is at least in part connected to said upper flange, a beam mounted along one edge of said slab spaced above said upper flange and fastening means rigidly connected it thereto, said beam receiving a wall of the section which is secured thereto and including a portion which extends below said upper flange, the lower flange of said I-beams spaced below said slab, further beams spaced substantially entirely below said slab rigidly interconnecting said I-beams.

23. A structural element as claimed in claim 22, wherein to said one beam which is disposed along an edge of said concrete slab, a further wall portion of said wall is secured to said one beam spaced inwardly from said first mentioned wall portion and in direct contact with said slab on its bottom.

24. A structural element which constitutes a panel for a floor to be incorporated in a box-shaped prefabricated section, said structural element comprising a rectangular slab composed of a cast concrete-like material, a peripheral rectangular frame of profiled metal beams with horizontal upper and lower flanges, said rectangular frame of beams having its outside dimensions substantially the same as the outside dimensions of said slab, said profiled beams all having substantially the same cross-section and being rigidly connected together, each said upper flange of said profiled beams received substantially in the said slab, said slab having been cast with said upper flange received therein and said lower flange spaced apart from the bottom of said slab, a reinforcement network situated at a level lower than said upper flange also cast within said slab and including upwardly inclined portions thereof rigidly attached to the top side of said upper flanges, a recess provided at each corner of said slab, an upright extension mounted on the top of said upper flange in each said recess whereby said extensions extend higher than the upper surface of said slab and said slab is in direct connecting contact with a vertical outer surface of said extension, each upper end of said extension received snugly in an opening defined by the periphery of the lower end of an upright supporting column provided at each vertically disposed corner of the section whereby the lower end of said column is connected to the upper end of said extension.

* * * * *